US006479448B2

(12) United States Patent
Cropper et al.

(10) Patent No.: US 6,479,448 B2
(45) Date of Patent: Nov. 12, 2002

(54) LIQUID DETERGENT COMPOSITION

(75) Inventors: James Dawson Cropper, Merseyside (GB); Nikki Sullivan, Merseyside (GB); Jenny Wiggans, Merseyside (GB)

(73) Assignee: Unilever Home & Personal Care USA, division of Conopco, Inc., Greenwich, CT (US)

( * ) Notice: Subject to any disclaimer, the term of this patent is extended or adjusted under 35 U.S.C. 154(b) by 0 days.

(21) Appl. No.: 09/855,110

(22) Filed: May 14, 2001

(65) Prior Publication Data

US 2002/0016280 A1 Feb. 7, 2002

(30) Foreign Application Priority Data

May 15, 2000 (EP) ..... 00304097

(51) Int. Cl.[7] ..... C11D 1/72; C11D 3/220; C11D 3/43; C11D 17/00

(52) U.S. Cl. ..... 510/296; 510/325; 510/337; 510/342; 510/343; 510/356; 510/421

(58) Field of Search ..... 510/325, 337, 510/338, 342, 343, 356, 407, 421, 296

(56) References Cited

U.S. PATENT DOCUMENTS

| | | | | |
|---|---|---|---|---|
| 4,394,125 A | * | 7/1983 | Holzle et al. | 8/103 |
| 4,456,452 A | * | 6/1984 | Holzle et al. | 8/103 |
| 4,610,799 A | | 9/1986 | Wilsberg et al. | 252/90 |
| 4,771,633 A | * | 9/1988 | Jacob | 73/151 |
| 4,830,652 A | | 5/1989 | Guenthner | 65/203 |
| 4,846,992 A | | 7/1989 | Fonsny | 252/90 |
| 4,973,416 A | | 11/1990 | Kennedy | 252/90 |
| 5,004,556 A | * | 4/1991 | Julemont et al. | 252/99 |
| 5,389,284 A | * | 2/1995 | van der Hoeven et al. | 252/174.22 |
| 5,759,981 A | | 6/1998 | Boutique et al. | 510/304 |
| 5,798,331 A | * | 8/1998 | Anderson et al. | 510/501 |
| 5,935,271 A | | 8/1999 | Lappas et al. | 8/137 |

FOREIGN PATENT DOCUMENTS

| | | |
|---|---|---|
| EP | 518 689 | 12/1962 |
| EP | 0 079 712 | 10/1982 |
| EP | 0 157 162 | 2/1985 |
| EP | 158 464 | 3/1985 |
| EP | 160 254 | 4/1985 |
| EP | 291 198 | 6/1988 |
| EP | 389 513 | 11/1988 |
| EP | 0 344 909 | 12/1989 |
| EP | 593 952 | 9/1993 |
| EP | 700 989 | 9/1994 |
| EP | 941 939 | 3/1999 |
| FR | 260 19 30 | 1/1988 |
| FR | 272 43 88 | 3/1996 |
| GB | 209 06 03 | 7/1982 |
| GB | 211 89 61 | 11/1983 |
| GB | 230 59 31 | 4/1997 |
| WO | 86/00251 | 1/1996 |
| WO | 97/00282 | 1/1997 |
| WO | 97/27743 | 8/1997 |
| WO | 99/00477 | 1/1999 |
| WO | 00/55044 | 9/2000 |
| WO | 00/55045 | 9/2000 |
| WO | 00/55046 | 9/2000 |
| WO | 00/55068 | 9/2000 |
| WO | 00/55069 | 9/2000 |
| WO | 00/55415 | 9/2000 |

OTHER PUBLICATIONS

Co–pending application: Applicant: Hewitt et al., Ser. No. 09/834,027; Filed: Apr. 12, 2001.

Co–pending application: Applicant: Hewitt et al., Ser. No. 09/834,026; Filed Apr. 12, 2001.

F. Schambil and M. Bocker, Tenside Surf. Det. 37 (2000) 1.

Derwent Abstract of EP 593 952—published Apr. 27, 1994.

Derwent Abstract of FR 260 19 30—published Jan. 29, 1998.

Derwent Abstract of FR 272 43 88—published Mar. 15, 1996.

* cited by examiner

*Primary Examiner*—Gregory Delcotto
(74) *Attorney, Agent, or Firm*—Rimma Mitelman

(57) ABSTRACT

The present invention relates to a concentrated liquid detergent composition with a pigment. The composition is color stable and the pigment remains stabily dispersed for at least 4 weeks at 37° C.

9 Claims, No Drawings

LIQUID DETERGENT COMPOSITION

FIELD OF THE INVENTION

The present invention relates to the field of liquid detergent compositions, in particular to coloured, highly concentrated liquid detergent compositions.

BACKGROUND OF THE INVENTION

In general dyes used to colour liquid detergent compositions are water soluble and can be used without difficulty in standard aqueous liquid detergent compositions. Instead of a water-soluble dye, a pigment may be used to colour the liquid detergent composition. Many pigments are known in the art and it is not difficult to obtain the right colour and the right intensity. Pigments have been suggested in EP-A-344909 as an ingredient for non-aqueous liquid compositions. U.S. Pat. No. 5,759,981 describes a non-aqueous bleaching liquid wherein the bleaching system contains a bleach catalyst (manganese phthalocyanine) and a perborate bleach. However, the incorporation of pigments in such a highly concentrated liquid detergent is still problematic. Liquid detergent compositions comprising pigments are difficult to stabilise because the pigments tend to flocculate over time making the product commercially unacceptable. Liquid detergent compositions may be sold in clear containers such as water-soluble films, but many pigments are not colour stable in such containers. Furthermore, pigments in such concentrated liquid detergents may cause spotting on laundry items. WO-A-99/00477 discloses nonaqueous liquid detergent compositions containing 400–1,500 micron speckles which contains conventional dyes or pigments.

SUMMARY OF THE INVENTION

Surprisingly, we have found that one or more of these problems can be solved by the present invention. The present invention provides a concentrated liquid detergent composition comprising 1–90% of a nonionic surfactant, 1–60% of an organic solvent, and 0.0001–2% of a pigment wherein more than 90% of the pigment particles have a particle size of less than 50 micron, preferably less than 30 micron, more preferably less than 10 micron, most preferably less than 1 micron. The pigment is dispersed in the composition in the form of particles of these specified sizes.

Another embodiment of the present invention relates to a process for preparing a concentrated liquid detergent composition comprising nonionic surfactant, an organic solvent and pigment, said process comprising the steps of mixing the nonionic surfactant with the organic solvent, adding to this mixture the pigment in the form of a pigment premix, and adding remaining ingredients.

Accordingly, the advantages of the inventive composition are that the composition, does not cause visible pigment spotting on the laundered clothing, the coloured liquid detergent compositions are colour stable in transparent containers and/or that the composition is stable, i.e. the pigments remain homogeneously dispersed in the liquid detergent composition after at least 6 wks storage at 37° C.

Neither EP-A-344909 nor U.S. Pat. No. 5,759,981 describes the above mentioned problems or suggests that the selection of this particle size distribution of the pigments would have these advantages.

DETAILED DESRIPTION OF THE INVENTION

Pigment

Pigments are particulate finely divided solids. Without wishing to be bound by theory it is believed that pigments are usually insoluble in the liquid detergent composition. On the other hand dyes are thought to be soluble or go into solution in the liquid detergent composition. For the purpose of this invention, pigments include those compounds such as indanthrone (Pigment Blue) which can both behave as a dye or a pigment depending on whether it is in a reduced or oxidised state. Pigments alter appearance either by selective absorption and/or scattering of light. In general, any pigment class compatible with the other ingredients of the liquid detergent composition may be used. A preferred group of pigments includes the coloured, white organic and inorganic pigments. Preferred examples of white inorganic pigments are titanium oxide, zinc oxide, zinc sulfate, lithophone and lead whites. Preferred examples of coloured inorganic pigments are iron oxide pigments, mixed-metal oxides (spinels, rutiles and zircon pigments, pigments based on bismuth vanadate, chromium (III), ultramarine, cyanide iron blues, cadmium, and lead chromate. Organic pigment is preferably selected from the group including azo pigments, BON reds and maroons, lakes, phthalocyanines, quinacridones, diaryl pyrrolopyrroles, VAT dye pigments, aminoanthraquinone, dioxazine, isoinolinones, isoindolines quinophthalones and mixtures thereof. Examples pigments are the Pigmosol™ range produced by BASF. It is referred that the pigment has a non-white colour, preferably a blue, green or blue-green colour.

One especially preferred class of pigment includes phthalocyanine and water-soluble and water-dispersible derivatives thereof.

One form of substitution possible for the present invention is substitution of the central metal by iron, manganese, cobalt, chromium, rhodium, ruthenium, Molybdenum or other transition metals.

A preferred phthalocyanine is selected from the group including copper phthalocyanine, cobalt phthalocyanine, derivatives thereof and mixtures thereof. Particularly preferred are copper phthalocyanine blue and copper phthalocyanine green and mixtures thereof.

Examples phthalocyanine pigments are sold under the trade names Hostafine Blue B2G, Colanyl Blue A2R, Colanyl Green GG 130 (ex Clariant UK).

However, it is essential that at least 90% of the pigment particles have a particle size of less than 50 micron, preferably less than 30 micron, even more preferably less than 10 micron, most preferably less than 1.0 micron. Preferably at least 90% of the pigment particles are larger than 0.001, more preferably larger than 0.005, most preferably larger than 0.01 micron.

To improve the stability of the pigment particles in the liquid detergent composition according the invention even further it is preferred that at least 50% of the pigment particles have a particle size of less than 10 micron, preferably less than 1 micron, even more preferably less than 0.60 micron, most preferably less than 0.50 micron. Preferably, at least 50% of particles have a particle size of more than 0.01, more preferably more than 0.1 most preferably more than 0.30 micron.

Preferably, the liquid detergent composition herein comprise at least 0.0001, more preferably 0.001 most preferably, 0.005% pigment and less than 2.0% more preferably, less 1.5% most preferably less than 1.0%.

The desired particle size distribution may be obtained by process known in the art such as milling and sieving. Preferably, the pigment in mixed with an organic solvent such as monopropylene glycol in a bead mill and sieved to obtain the desired particle size distribution.

The particle size may be measured with commercially available means such as the HELOS™ system produced by Sympatec GmbH (Germany) which uses a Laser Diffraction sensor. In this system, particles cause a diffraction of the laser light in the spectrum which is converted into an image that can be detected by a photo detector, that converts the intensity of the light into electrical signals, which will be processed by computational means using the software provided. The computer programme converts the data into particle size distribution and the cumulative particle size.

Liquid Detergent Composition

The liquid detergent composition according the invention is a highly concentrated composition. Preferably, the composition comprises 25% or less, more preferably less than 20% by weight water. More preferably, the composition is non-aqueous liquid detergent composition comprising less than 15%, more preferably less than 10% water. In either case, the liquid detergent composition preferably comprises more than 1% water, more preferably more than 4%, most preferably, more than by weight 6% water. The liquid detergent compositions may be in the form of a liquid, gel or paste.

The substantially non-aqueous liquid composition may be substantially Newtonion or else non-Newtonion in rheology. The latter especially applies when the composition comprises dispersed solids. Therefore, for the avoidance of doubt, all viscosities expressed herein are measured at a shear rate of $21s^{-1}$.

The viscosity of the composition is preferably from 25 mPaS, 50 mPaS, 75 mPaS or 100 mPaS, preferably 125 mPaS, more preferably 150 mPaS to 10,000 mPaS, for example above 150 mPaS but no more than 10,000 mPaS. The alternative embodiment of the invention relates to VFFS encapsulation in which case, the minimum viscosity must be 150 mPaS, for example above 150 mPaS.

The composition may be considered as falling into the sub-classes of thin liquids, thick liquids, and gels/pastes.

The thin liquids may have a minimum viscosity of 25, 50, 75, 100, 125 ,150 mPaS or above 150 mPaS for example 175 mPaS, preferably 200 mPaS. They may for example have a maximum viscosity of 500 mPaS preferably 450 mPaS more preferably 400 mPaS or even 250 mPaS.

The thick liquids may have a minimum viscosity of 400 mPaS, for example 350 mPaS, or even 300 mPaS and a maximum viscosity of 1,500 mPaS, preferably 1,200 mPaS.

The gels or pastes may have a minimum viscosity of 1,400 mPaS, for example 1,500 mPaS, preferably 1,750 mPaS, 2000 mPaS, 2,500 mPaS, 3,000 mPaS or even 3,500 mPaS. Their maximum viscosity may be 10,000 mPaS, preferably 9,000 mPaS, more preferably 8,000 mPaS, 7,500 mPaS or even 4,000 mPaS.

Surfactants

The amount of the surfactant component of the liquid detergent compositions herein can vary depending upon the nature and amount of other composition components and depending upon the desired rheological properties of the ultimately formed composition.

Generally, this surfactant component or surfactant mixture will be used in an amount comprising from about 10% to 90% by weight of the composition. More preferably, the surfactant mixture will comprise from about 30% to 60% by weight of the composition.

A typical listing of anionic, nonionic, ampholytic and zwitterionic classes, and species of these surfactants, is given in U.S. Pat. No. 3,664,961 issued to Norris on May 23, 1972.

The liquid detergent composition according the invention comprises 10–70% of at least one nonionic surfactant.

One class of nonionic surfactants useful in the present invention are condensates of ethylene oxide with a hydrophobic moiety to provide a surfactant having an average hydrophilic-lipophilic balance (HLB) in the range from 8 to 17, preferably from 9.5 to 14, more preferably from 12 to 14. The hydrophobic (lipophilic) moiety may be aliphatic or aromatic in nature and the length of the polyoxyethylene group which is condensed with any particular hydrophobic group can be readily adjusted to yield a water-soluble compound having the desired degree of balance between hydrophilic and hydrophobic elements.

Especially preferred nonionic surfactants of this type are the C9–C15 primary alcohol ethoxylates containing 3–12 moles of ethylene oxide per mole of alcohol, particularly the C9–C12 primary alcohols containing 4–8 moles of ethylene oxide per mole of alcohol.

An especially preferred class of nonionic surfactants are alcohol alkoxylates. Such materials correspond to the general formula:

R1(CmH2mO)nOH wherein R1 is a C8–C16 alkyl group, m is from 2 to 4, and n ranges from about 2 to 12. Preferably R1 is an alkyl group, which may be primary or secondary, that contains from about 9 to 15 carbon atoms, more preferably from about 11 to 13 carbon atoms.

Preferably also the alkoxylated fatty alcohols will be ethoxylated materials that contain from about 2 to 12 ethylene oxide moieties per molecule, more preferably from about 3 to 10 ethylene oxide moieties per molecule.

The alkoxylated fatty alcohol will frequently have a hydrophilic-lipophilic balance (HLB) which ranges from about 3 to 17. More preferably, the HLB of this material will range from about 6 to 15, most preferably from about 8 to 15.

Examples of fatty alcohol alkoxylates useful as one of the essential components in the compositions herein will include those which are made from alcohols of 12 to 15 carbon atoms and which contain about 7 moles of ethylene oxide. Such materials have been commercially marketed under the trade names Neodol 25-7 and Neodol 23-6.5 by Shell Chemical Company.

Especially preferred Neodols include Neodol 1-5, an ethoxylated fatty alcohol averaging 11 carbon atoms in its alkyl chain with about 5 moles of ethylene oxide; Neodol 1-7 an ethoxylated fatty alcohol averaging 11 carbon atoms in its alkyl chain with about 5 moles of ethylene oxide; Neodol 23-9, an ethoxylated primary C12–C13 alcohol having about 9 moles of ethylene oxide and Neodol 91-10, an ethoxylated C9–C11 primary alcohol having about 10 moles of ethylene oxide.

Alcohol ethoxylates of this type have also been marketed by Shell Chemical Company under the Dobanol trade name.

Dobanol 91-5 is an ethoxylated C9–CII fatty alcohol with an average of 5 moles ethylene oxide and Dobanol 25-7 is an ethoxylated C12–C15 fatty alcohol with an average of 7 moles of ethylene oxide per mole of fatty alcohol.

Other examples of suitable ethoxylated alcohols include Tergitol 15-S-7 and Tergitol 15-S-9 both of which are linear secondary alcohol ethoxylates that have been commercially marketed by Union Carbide Corporation. The former is a mixed ethoxylation product of C11 to C15 linear secondary alkanol with 7 moles of ethylene oxide and the latter is a similar product but with 9 moles of ethylene oxide being reacted.

Other types of alcohol ethoxylates useful in the present compositions are higher molecular weight nonionics, such as Neodol 45-11, which are similar ethylene oxide condensation products of higher fatty alcohols, with the higher fatty alcohol being of 14–15 carbon atoms and the number of ethylene oxide groups per mole being about 11.

Such products have also been commercially marketed by Shell Chemical Company.

Another class of nonionic surfactants comprises alkyl polyglucoside compounds of general formula RO(CnH2nO)tZx wherein Z is a moiety derived from glucose; R is a saturated hydrophobic alkyl group that contains from 12 to 18 carbon atoms; t is from 0 to 10 and n is 2 or 3; x is from 1.3 to 4, the compounds including less than 10% unreacted fatty alcohol and less than 50% short chain alkyl polyglucosides. Compounds of this type and their use in detergent are disclosed in EP-B 0 070 077, 0 075 996 and 0 094 118.

Also suitable as nonionic surfactants are poly hydroxy fatty acid amide surfactants of the formula

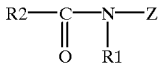

wherein R1 is H, or R1 is C1–4 hydrocarbyl, 2-hydroxy ethyl, 2-hydroxy propyl or a mixture thereof, R2 is C5–31 hydrocarbyl, and Z is a polyhydroxyhydrocarbyl having a linear hydrocarbyl chain with at least 3 hydroxyls directly connected to the chain, or an alkoxylated derivative thereof. Preferably, R1 is methyl, R2 is a straight C 11–15 alkyl or alkenyl chain such as coconut alkyl or mixtures thereof, and Z is derived from a reducing sugar such as glucose, fructose, maltose, lactose, in a reductive amination reaction.

Preferably, the liquid detergent compositions according the invention comprises more than 26%, preferably more than 30% nonionic surfactant and preferably less than 65 more preferably less than 60% of nonionic surfactant.

Anionic Surfactant

In addition, the liquid detergent compositions of the invention preferably comprises an anionic surfactant. Highly preferred anionic surfactants are the linear alkyl benzene sulfonate (LAS) materials. Such surfactants and their preparation are described for example in U.S. Pat. Nos. 2,220,099 and 2,477,383, incorporated herein by reference. Especially preferred are the sodium and potassium linear straight chain alkylbenzene sulfonates in which the average number of carbon atoms in the alkyl group is from about11to 14.

Sodium C11–C14, e.g., C12, LAS is especially preferred. Preferred anionic surfactants include the alkyl sulfate surfactants hereof are water soluble salts or acids of the formula ROS03M wherein R preferably is a C10–C24 hydrocarbyl, preferably an alkyl or hydroxyalkyl having a C10–C18 alkyl component, more preferably a C12–C15 alkyl or hydroxyalkyl, and M is H or a cation, e.g., an alkali metal cation (e.g. sodium, potassium, lithium), or ammonium or substituted ammonium (quaternary ammonium cations such as tetramethyl-ammonium and dimethyl piperdinium cations).

Highly preferred anionic surfactants include alkyl alkoxylated sulfate surfactants hereof are water soluble salts or acids of the formula RO(A)mSO3M wherein R is an unsubstituted C10–C24 alkyl or hydroxyalkyl group having a C10–C24 alkyl component, preferably a C12–C18 alkyl or hydroxyalkyl, more preferably C12–C15 alkyl or hydroxyalkyl, A is an ethoxy or propoxy unit, m is greater than zero, typically between about 0.5 and about 6, more preferably between about 0.5 and about 3, and M is H or a cation which can be, for example, a metal cation (e.g., sodium, potassium, lithium, calcium, magnesium, etc.), ammonium or substituted-ammonium cation. Alkyl ethoxylated sulfates as well as alkyl propoxylated sulfates are contemplated herein. Specific examples of substituted ammonium cations include quaternary ammonium cations such as tetra methyl-ammonium and dimethyl piperdinium cations Exemplary surfactants are C12–C15 alkyl polyethoxylate (1.0) sulfate (C12–C15E(1.0)M), C12–C15 alkyl polyethoxylate (2.25) sulfate (C12–C15E(2.25)M), C12–C15 alkyl polyethoxylate (3.0) sulfate (C12–C15E(3.0)M), and C12–C15 alkyl polyethoxylate (4.0) sulfate (C12–C15E(4.0)M), wherein M is conveniently selected from sodium and potassium.

One preferred class of anionic surfactants comprises alkylbenzenes sulfonic acids or the alkali salts thereof whereby the alkylbenzenes are alkylated using HF as alkylation katalyst.

Other suitable anionic surfactants to be used are alkyl ester sulfonate surfactants including linear esters Of C8–C20 carboxylic acids (i.e., fatty acids) which are sulfonated with gaseous SO3 according to "The Journal of the American Oil Chemists Society", 52 (1975), pp. 323–329. Suitable starting materials would include natural fatty substances as derived from tallow, palm oil, etc. The preferred alkyl ester sulfonate surfactant, comprise alkyl ester sulfonate surfactants of the structural formula:

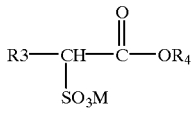

wherein R3 is a C8–C20 hydrocarbyl, preferably an alkyl, or combination thereof, R4 is a C1–C6 hydrocarbyl, preferably an alkyl, or combination thereof, and M is a cation which forms a water soluble salt with the alkyl ester sulfonate. Suitable salt-forming cations include metals such as sodium, potassium, and lithium, and substituted or unsubstituted ammonium cations.

Preferably, R3 is C10–C16 alkyl, and R4 is methyl, ethyl or isopropyl.

Especially preferred are the methyl ester sulfonates wherein R3 is C10–C16 alkyl.

Other anionic surfactants useful for detersive purposes can also be included in the laundry detergent compositions of the present invention.

These can include salts, for example, sodium, potassium, ammonium, and substituted ammonium salts such as mono-, di- and triethanolamine salts) of soap, C9–C20 linear alkylbenzenesulfonates, C8–C22 primary of secondary alkanesulfonates, C8–C24 olefinsulfonates, sulfonated polycarboxylic acids prepared by sulfonation of the pyrolyzed product of alkaline earth metal citrates, e.g., as described in British patent specification No. 1,082,179, C8–C24 alkylpolyglycolethersulfates (containing up to 10 moles of ethylene oxide); alkyl glycerol sulfonates, fatty acyl glycerol sulfonates, fatty oleyl glycerol sulfates, alkyl phenol ethylene oxide ether sulfates, paraffin sulfonates, alkyl phosphates, isethionates such as the acyl isethionates, N-acyl taurates, alkyl succinamates and sulfosuccinates, monoesters of sulfosuccinates (especially saturated and unsaturated C12–C18 monoesters) and diesters of sulfosuccinates (especially saturated and unsaturated C6–C12 diesters), sulfates of alkylpolysaccharides such as the sulfates of alkylpolyglucoside (the nonionic nonsulfated compounds being described below), and alkyl polyethoxy carboxylates such as those of the formula RO(CH2CH20)k-

CH2COO—M+ wherein R is a C8–C22 alkyl, k is an integer from 1 to 10, and M is a soluble salt-forming cation. Resin acids and hydrogenated resin acids are also suitable, such as rosin, hydrogenated rosin, and resin adds and hydrogenated resin acids present in or derived from tall oil.

Further examples are described in "Surface Active Agents and Detergents" (Vol. I and 11 by Schwartz, Perry and Berch). A variety of such surfactants are also generally disclosed in U.S. Pat. No. 3,929,678, issued Dec. 30, 1975 to Laughhn, et al. at Column 23, line 58 through Column 29, line 23.

When included therein, the detergent compositions of the present invention typically comprise from about 1% to about 40%, preferably from about 10% to about 25% by weight of such anionic surfactants.

Fatty Acids

Another preferred component are fatty acids. Examples of fatty adds suitable for use of the present invention include pure or hardened fatty acids derived from palmitoleic, safflower, sunflower, soybean, oleic, linoleic, linolenic, ricinoleic, rapeseed oil or mixtures thereof. Mixtures of saturated and unsaturated fatty acids can also be used herein.

It will be recognised &at the fatty add will be present in the liquid detergent composition primarily in the form of a soap. Suitable cations include, sodium, potassium, ammonium, monoethanol ammonium diethanol ammonium, triethanol ammonium, tetraalkyl ammonium, e.g., tetra methyl ammonium up to tetradecyl ammonium etc. cations.

The amount of fatty acid will vary depending on the particular characteristics desired in the final detergent composition.

For any detergent compositions to be used in automatic laundry washing machines, suds should not form to the extent that they overflow the washing machine. Suds suppressors, when utilised, are preferably present in a "suds suppressing amount". By "suds suppressing amount" is meant that the formulator of the composition can select an amount of this suds controlling agent that will sufficiently control the suds to result in a low-sudsing laundry detergent for use in automatic laundry washing machines, particularly in the rinse.

Preferably, the level of the fatty acid mixture is from 0. 1% to 30%, more preferably from 0.5% to 25%, more preferably from 10–20% by weight of the detergent composition. Preferably, the liquid detergent composition of the present invention comprise a fatty acid mixture characterised in that said fatty acid mixture comprises at least 30% of fatty acid having 16 or more carbon atoms.

Preferred fatty acid mixtures comprise at least 90% of saturated fatty acid and/or at least 50% of fatty acid having 16 or more carbon atoms. Highly preferred fatty acid mixtures comprise at least 50% of fatty acid having C16–C18 chain lengths. Especially preferred fatty acid is oleic fatty acid.

Organic Solvent

Another component of the liquid detergent composition herein comprises non-aqueous, low-polarity organic solvent (s). The term "solvent" is used herein to connote the non-surface active carrier or diluent portion of the liquid phase of the composition. While some of the essential and/or optional components of the compositions herein may actually dissolve in the "solvent"-containing phase, other components will be present as particulate material dispersed within the "solvent" -containing phase. Thus the term "solvent" is not meant to require that the solvent material be capable of actually dissolving all of the detergent composition components added thereto.

The non-aqueous organic materials which are employed as solvents herein are those which are liquids of low polarity. For purposes of this invention, "low-polarity" liquids are those which have little, if any, tendency to dissolve one of the types of particulate material, if these are used in the compositions herein, e.g., peroxygen bleaching agents, sodium perborate or sodium percarbonate. Suitable types of low-polarity solvents useful in the liquid detergent compositions herein do include alkylene glycol mono lower alkyl ethers, lower molecular weight polyethylene glycols, lower molecular weight methyl esters and amides, and the like.

A preferred type of organic solvent for use herein comprises the mono-, di-, tri-, or tetra- C2–C3 alkylene glycol mono C2–C6 alkyl ethers. The specific examples of such compounds include diethylene glycol monobutyl ether, tetraethylene glycol monobutyl ether, dipropolyene glycol monoethyl ether, and dipropylene glycol monobutyl ether. Diethylene glycol monobutyl ether and dipropylene glycol monobutyl ether are especially preferred. Compounds of the type have been commercially marketed under the trade names Dowanol, Carbitol, and Cellosolve.

Another preferred type of organic solvent useful herein comprises the lower molecular weight polyethylene glycols (PEGs). Such materials are those having molecular weights of at least about 150. PEGs of molecular weight ranging from about 200 to 600 are most preferred. An especially preferred solvent is selected from the group including monopropylene glycol, glycerol, polyethylene glycol and mixtures thereof.

Yet another preferred type of organic solvent comprises lower molecular weight methyl esters.

Such materials are those of the general formula: R1-C (O)—OCH3 wherein R1 ranges from 1 to about 18. Examples of suitable lower molecular weight methyl esters include methyl acetate, methyl propionate, methyl octanoate, and methyl dodecanoate.

The organic solvent(s) employed should, of course, be compatible and non-reactive with other composition components, e.g., bleach and/or activators, used in the liquid detergent compositions herein. Such a solvent component will generally be utilised in an amount of from about 1% to 60% by weight of the composition. More preferably, the organic solvent will comprise from about 10% to 40% by weight of the composition, most preferably from about 15% to 30% by weight of the composition.

Solid Phase

The liquid detergent compositions herein may further comprise a solid phase of particulate material which is dispersed and suspended within the liquid phase.

Generally such particulate material will range in size from about 0.1 to 1500 microns. More preferably such material will range in size from about 5 to 500 microns.

The particulate material utilised herein can comprise one or more types of detergent composition components which in particulate form are substantially insoluble in the non-aqueous liquid phase of the composition. The types of particulate materials which can be utilised are described in detail as follows:

Peroxygen Bleaching Agent With Optional Bleach Activators

The most preferred type of particulate material useful for forming the solid phase of the detergent compositions herein comprises particles of a peroxygen bleaching agent.

Such peroxygen bleaching agents may be organic or inorganic in nature. Inorganic peroxygen bleaching agents are frequently utilised in combination with a bleach activator.

Useful organic peroxygen bleaching agents include percarboxylic acid bleaching agents and salts thereof.

Suitable examples of this class of agents include magnesium monoperoxyphthalate hexahydrate, the magnesium salt of metachloro perbenzoic acid, 4-nonylamino-4-oxoperoxybutyric acid and diperoxydodecanedioic acid. Such bleaching agents are disclosed in U.S. Pat. No. 4,483,781, Hartman, Issued Nov. 20, 1984; European Patent Application EP-A-133,354, Banks et al., Published Feb. 20, 1985; and U.S. Pat. No. 4,412,934, Chung et al., Issued Nov. 1, 1983. Highly preferred bleaching agents also include 6-nonyl amino-6-oxoperoxycaproic acid (NAPAA) as described in U.S. Pat. No. 4,634,551, Issued Jan. 6, 1987 to Burns et al.

Inorganic peroxygen bleaching agents may also be used in particulate form in the detergent compositions herein.

Inorganic bleaching agents are in fact preferred. Such inorganic peroxygen compounds include alkali metal perborate and percarbonate materials, most preferably the percarbonates. For example, sodium perborate (e.g. mono- or tetra-hydrate) can be used. Suitable inorganic bleaching agents can also include sodium or potassium carbonate peroxyhydrate and equivalent "percarbonate" bleaches, sodium pyrophosphate peroxyhydrate, urea peroxyhydrate, and sodium peroxide. Persulfate bleach (e.g., OXONE, manufactured commercially by DuPont) can also be used. Frequently inorganic peroxygen bleaches will be coated with silicate, borate, sulfate or water-soluble surfactants. For example, coated percarbonate particles are available from various commercial sources such as FMC, Solvay Interox, Tokai Denka and Degussa.

Inorganic percxygen bleaching agents, e.g., the perborates, the percarbonates, etc., are preferably combined with bleach activators, which lead to the in situ production in aqueous solution (i.e., during use of the compositions herein for fabric laundering/bleaching) of the peroxy acid corresponding to the bleach activator. Various non-limiting examples of activators are disclosed in U.S. Pat. No. 4,915,854, Issued Apr. 10, 1990 to Mao et al.; and U.S. Pat. No. 4,412,934 Issued Nov. 1, 1983 to Chung et al. The nonanoyloxybenzene sulfonate (NOBS) and tetraacetyl ethylene diamine (TAED) activators are typical. Mixtures thereof can also be used. See also the hereinbefore referenced U.S. Pat. No. 4,634,551 for other typical bleaches and activators useful herein.

Preferred examples of bleach activators include (6-octanamido-caproyl)oxybenzene-sulfonate, (6-nonanamidocaproyl) oxybenzenesulfonate, (6-decanamido-caproyal)oxybenzenesulfonate and mixtures thereof as described in the hereinbefore referenced U.S. Pat. No. 4,634,551. Such mixtures are characterised herein as (6 - C8–C10 alkamido-caproyl)oxybenzenesulfonate.

Another class of useful bleach activators comprises the benzoxazin-type activators disclosed by Hodge et al. in U.S. Pat. No. 4,966,723, Issued Oct. 30, 1990, incorporated herein by reference. Highly preferred lactam activators include benzoyl caprolactam, octanoyl caprolactam, 3,5,5-trimethylhexanoyl caprolactam, nonanoyl caprolactam, decanoyl caprolactam, undecenoyl caprolactam, benzoyl valerolactam, octanoyl valerolactam, decanoyl valerolactam, undecenoyl valerolactam, 3,5,5-trimethylhexanoyl valerolactam. and mixtures thereof. See also U.S. Pat. No. 4,545,784, Issued to Sanderson, Oct. 8, 1985, incorporated herein by reference, which discloses acyl caprolactams, including benzoyl caprolactam, adsorbed into sodium perborate.

If peroxygen bleaching agents are used as all or part of the essentially present particulate material, they will generally comprise from about 1% to 30% by weight of the composition. More preferably, peroxygen bleaching agent will comprise from about 1% to 20% by weight of the composition. Most preferably, peroxygen bleaching agent will be present to the extent of from about 3% to 15% by weight of the composition. If utilised, bleach activators can comprise from about 0.5% to 20%, more preferably from about 1% to 10%, by weight of the composition. Frequently, activators are employed such that the molar ratio of bleaching agent to activator ranges from about 1:1 to 10:1, more preferably from about 1.5:1 to 5:1.

In addition, it has been found that bleach activators, when agglomerated with certain acids such as citric acid, are more chemically stable.

Thickening, Viscosity Control And/Or Dispersing Agents

The detergent compositions herein may also optionally contain a polymeric material which serves to enhance the ability of the composition to maintain its solid particulate components in suspension. Such materials may thus act as thickeners, viscosity control agents and/or dispersing agents. Such materials are frequently polymeric poiycarboxylates but can include other polymeric materials such as polyvinylpyrrolidone (PVP) and polymeric amine derivatives such as quaternized, ethoxylated hexamethylene diamines.

Polymeric polycarboxylate materials can be prepared by polymerising or copolymerising suitable unsaturated monomers, preferably in their acid form. Unsaturated monomeric acids that can be polymerised to form suitable polymeric polycarboxylates include acrylic acid, maleic acid (or maleic anhydride), fumaric acid, itaconic acid, aconitic acid, mesaconic acid, citraconic acid and methylenemalonic acid. The presence in the polymeric polycarboxylates herein of monomeric segments, containing no carboxylate radicals such as vinylmethyl ether, styrene, ethylene, etc. is suitable provided that such segments do not constitute more than about 40% by weight of the polymer.

Particularly suitable polymeric polycarboxylates can be derived from acrylic acid. Such acrylic acid-based polymers which are useful herein are the water-soluble salts of polymerised acrylic acid. The average molecular weight of such polymers in the acid form preferably ranges from about 2,000 to 10,000, more preferably from about 4,000 to 7,000, and most preferably from about 4,000 to 5,000. Water-soluble salts of such acrylic acid polymers can include, for example, the alkali metal, salts. Soluble polymers of this type are known materials. Use of polyacrylates of this type in detergent compositions has been disclosed, for example, Diehl, U.S. Pat. No. 3,308,067, issued Mar. 7, 1967. Such materials may also perform a builder function.

If utilised, the optional thickening, viscosity control and/or dispersing agents should be present in the compositions herein to the extent of from about 0.1% to 4% by weight. More preferably, such materials can comprise from about 0.5% to 2% by weight of the detergents compositions herein.

Minors

The detergent compositions herein preferably at least one minor component selected from the group including conventional brighteners, suds suppressors, silicone oils, bleach catalysts, (terephtalate-based) soil release polymers, anti-dye transfer agents, anti-wrinkling polymers, enzymes and/or perfume materials. The enzyme is preferably selected from the group including protease, cellulase, lipase, amylase, other enzymes suitable for the cleaning of laundry.

Such minor components must, of course, be compatible and non-reactive with the other composition components. If present, brighteners suds suppressors and/or perfumes will typically comprise from about 0.01% to 2% by weight of the compositions herein.

Encapsulates

In one particularly preferred embodiment, the liquid detergent compositions of the invention is encapsulated in a water soluble film. Preferably, the water-soluble film comprises polyvinylalcohol (PVOH), in particular more than 50 wt % polyvinylalcohol and preferably also one or more carboxy-functional monomers. If the liquid detergent composition is to be encapsulated in a water-soluble film it is preferred that the composition does not comprise solid builders or solid bleaches other than the pigment. In addition, it is preferable that the liquid detergent composition can be stabily encapsulated in water-soluble film, i.e., the thus encapsulated composition and film should be stable for at least 4 wks at 37° C.: the film should not break or become brittle.

PVOH can be made by the polymerisation of vinyl acetate, followed by hydrolysis, conveniently by reaction with sodium hydroxide. However, the resulting film has a highly symmetrical, hydrogen-bonded structure and is not readily soluble in cold water. PVOH films which are suitable for the formation of water soluble packages are typically polymers produced from copolymerisation of vinyl acetate and another comonomer which contains a carboxylic function. Examples of such comonomers include monocarboxylates, such as acrylic acid, and dicarboxylates, such as itaconic acid, which may be present during polymerisation as esters. Alternatively, the anhydride of maleic acid may be used as the copolymer. The inclusion of the comonomer reduces the symmetry of and degree of hydrogen bonding in the final film and renders the film soluble even in cold water.

However, when the resultant copolymer film contains carboxylic acid or carboxylate groups (either of these hereinafter being referred to as "carboxylate functionality") in proximity to hydroxyl groups on the same carbon chain and there is an attendant drive towards cyclisation of these groups by water elimination to form lactones. A low level of lactone formation is desirable to improve the mechanical properties of the film. However, the formation of excessive amounts of lactones is undesirable as this tends to reduce the cold water solubility of the film, giving rise to a danger of undissolved film residues when the package is used.

The problem of excessive lactone formation is particularly acute when the liquid composition inside the package comprises ionic species. This is thought to be because the presence of ionic species can give rise to exchange between sodium ions (associated with carboxylate groups) in the film and hydrogen ions in the liquid composition. Once such exchange has occurred, the resulting carboxylic acid group in the film can cyclise with a neighbouring hydroxyl group, eliminating water in the process, thus forming lactones.

This problem is avoided by providing in the composition, a molar excess (with respect to the amount of exchangeable hydrogen ions in the at least one ionic ingredient) of a stabilising compound effective for combining with the exchangeable hydrogen ions to hinder the formation of lactones, especially β lactones within the film; with the proviso that if the stabilising compound is or comprises an inorganic base and/or ammonium hydroxide then it is present in an amount of at least 95 mole % of the amount to completely neutralise the at least one ionic ingredient.

The Stablilising Compound

The provision of a molar excess (with respect to the amount of exchangeable hydrogen ions in the at least one ionic ingredient) of the stabilising compound in the liquid composition is found to have a significant effect in maintaining the cold water solubility of the film through the hindrance of lactone formation. However, in the case of inorganic bases and/or ammonium hydroxide forming all or part of the stabilising compound, the amount of stabilising compound need not be in excess, provided it is at least 95 mole % of the amount needed for full neutralisation. Surprisingly, the hindrance of lactone formation is significantly greater when these amounts of stabilising compound is used than when a molar equivalent or less is used. This advantageous effect is particularly marked after prolonged storage (eg for several weeks) of the package according to the invention at elevated temperature (eg 37° C.), conditions which are frequently encountered by some commercial products in European and other markets.

The problem of excessive lactone formation is particularly acute when the liquid composition inside the package comprises ionic species having an exchangeable hydrogen ion, for example fatty acids or the acid precursors of anionic surfactants.

This problem may be solved by including in the composition, a stabilising compound effective for combining with the exchangeable hydrogen ions to hinder the formation of lactones within the film. This stabilising compound should preferably be in molar excess relative to the component(s) having an exchangeable ion. This molar excess is preferably up to 105 mole %, preferably up to 110 mole % of the stoichiometric amount necessary for complete neutralisation. It is preferably an organic base such as one or more amines, e.g. monoethanolamine, triethanolamine and mixtures thereof. When the stabilising compound is or comprises an inorganic base such as an alkali metal (e.g. sodium or potassium) hydroxide, or ammonium hydroxide, it may, however, present in an amount as low as 95 mole %, eg. from 95 mole % to 105 mole % relative to the component (s) having an exchangeable hydrogen ion.

Other possible inorganic stabilising compounds are alkaline earth metal hydroxides or other inorganic bases which do liberate water on protonation. These are preferably also used in an amount indicated above for the alkali metal hydroxides and ammonium hydroxide.

Yet other suitable stabilising compounds are amines other than monoethanolamine and triethanolamine, and organic Lewis bases or other organic or inorganic bases provided that they will interact effectively with labile protons within the detergent composition to hinder the production of lactones in the film.

The Ionic Ingredient With Exchangeable Hydrogen Ions

When present, the ionic ingredient with exchangeable hydrogen ions may, for example, constitute from between 1% and 40% (prior to any neutralisation) by weight of the total substantially non-aqueous liquid composition. When used primarily for their surfactant properties, such ingredients may for example be present in amounts greater than 10% by weight. When used as deflocculants (see below), the amounts may be 10% by weight or less, e.g. no more than 5% by weight. These ingredients may for example be selected from anionic surfactant acid precursors and fatty acids and mixtures thereof.

Anionic surfactant acids are well known to those skilled in the art. Examples suitable for use in a liquid composition according to the invention include alkylbenzene sulphonic acid, particularly $C_{8-15}$ linear alkylbenzene sulphonic acids and mixtures thereof. Other suitable surfactant acids include the acid forms of olefin sulphonates, alkyl ether sulphates, alkyl sulphates or alkane sulphonates and mixtures thereof.

A wide range of fatty acids are suitable for inclusion in a liquid composition according to the invention, for example selected from one or more $C_{8-24}$ alkyl or alkenyl monocarboxylic acids. Saturated or unsaturated fatty acids may be used. Examples of suitable fatty acids include oleic acid, lauric acid or hardened tallow fatty acid.

The Water Soluble Package

Any reference herein to filling refers to complete filling and also partial filling whereby some air or other gas is also trapped in the sealed envelope.

The envelope forming the package is preferably formed by horizontal or vertical form-film-seal technique.

(a) The Copolymer Film

A preferred plastics film is a polyvinyl alcohol film, especially one made of a polyvinyl alcohol copolymer having a comonomer having a carboxylate function.

PVOH can be made by the polymerisation of vinyl acetate, followed by hydrolysis, conveniently by reaction with sodium hydroxide. However, the resulting film has a highly symmetrical, hydrogen-bonded structure and is not readily soluble in cold water. PVOH films which are suitable for the formation of water soluble packages are typically polymers produced from copolymerisation of vinyl acetate and another comonomer which contains a carboxylic function. Examples of such comonomers include monocarboxylates, such as acrylic acid, and dicarboxylates, such as itaconic acid, which may be present during polymerisation as esters. Alternatively, the anhydride of maleic acid may be used as the copolymer. The inclusion of the comonomer reduces the symmetry of and degree of hydrogen bonding in the final film and renders the film soluble even in cold water.

Suitable PVOH films for use in a package according to the invention are commercially available and described, for example, in EP-B-0291198. PVOH films for use in a package according to the invention can be made by the copolymerisation of vinyl acetate and a carboxylate-containing monomer (for example acrylic, maleic or itaconic acid or acid ester), followed by partial (for example up to about 90%) hydrolysis with sodium hydroxide.

(b) Horizontal Form-Fill-Seal

Water soluble PVOH packages of the invention can be made according to any of the methods horizontal form-fill-seal described in any of WO-A-00/55044, WO-A-00/55045, WO-A-00/55046, WO-A-00/55068, WO-A-00/55069 and WO-A-00/55415.

By way of example, a thermoforming process is now described where a number of packages according to the invention are produced from two sheets of water soluble material. In this regard recesses are formed in the film sheet using a forming die having a plurality of cavities with dimensions corresponding generally to the dimensions of the packages to be produced. Further, a single heating plate is used for thermoforming the film for all the cavities, and in the same way a single sealing plate is described.

A first sheet of polyvinyl alcohol film is drawn over a forming die so that the film is placed over the plurality of forming cavities in the die. In this example each cavity is generally dome shape having a round edge, the edges of the cavities further being radiussed to remove any sharp edges which might damage the film during the forming or sealing steps of the process. Each cavity further includes a raised surrounding flange. In order to maximise package strength; the film is delivered to the forming die in a crease free form and with minimum tension. In the forming step, the film is heated to 100 to 120° C., preferably approximately 110° C., for up to 5 seconds, preferably approximately 700 micro seconds. A heating plate is used to heat the film, which plate is positioned to superpose the forming die. During this preheating step, a vacuum of 0.5 bar is pulled through the pre-heating plate to ensure intimate contact between the film and the pre-heating plate, this intimate contact ensuring that the film is heated evenly and uniformly (the extent of the vacuum is dependant of the thermoforming conditions and the type of film used, however in the present context a vacuum of less than 0.6 bar was found to be suitable) Non-uniform heating results in a formed package having weak spots. In addition to the vacuum, it is possible to blow air against the film to force it into intimate contact with the preheating plate.

The thermoformed film is moulded into the cavities blowing the film off the heating plate and/or by sucking the film into the cavities thus forming a plurality of recesses in the film which, once formed, are retained in their thermoformed orientation by the application of a vacuum through the walls of the cavities. This vacuum is maintained at least until the packages are sealed. Once the recesses are formed and held in position by the vacuum, a liquid composition according to the invention is added to each of the recesses. A second sheet of polyvinyl alcohol film is then superposed on the first sheet across the filled recesses and heat-sealed thereto using a sealing plate. In this case the heat sealing plate, which is generally flat, operates at a temperature of about 140 to 160° C., and contacts the films for 1 to 2 seconds and with a force of 8 to 30kg/cm$^2$, preferably 10 to 20kg/cm$^2$. The raised flanges surrounding each cavity ensure that the films are sealed together along the flange to form a continuous seal. The radiussed edge of each cavity is at least partly formed by a resiliently deformable material, such as for example silicone rubber. This results in reduced force being applied at the inner edge of the sealing flange to avoid heat/pressure damage to the film.

Once sealed, the packages formed are separated from the web of sheet film using cutting means. At this stage it is possible to release the vacuum on the die, and eject the formed packages from the forming die. In this way the packages are formed, filled and sealed while nesting in the forming die. In addition they may be cut while in the forming die as well.

During the forming, filling and sealing steps of the process, the relative humidity of the atmosphere is controlled to ca. 50% humidity. This is done to maintain the heat sealing characteristics of the film. When handling thinner films, it may be necessary to reduce the relative humidity to ensure that the films have a relatively low degree of plasticisation and are therefore stiffer and easier to handle.

(c) Vertical Form-Fill-Seal

In the vertical form-fill-seal (VFFS) technique, a continuous tube of flexible plastics film is extruded. It is sealed, preferably by heat or ultrasonic sealing, at the bottom, filled with the liquid composition, sealed again above the liquid film and then removed rom the continuous tube, e.g. by cutting.

Unit Dose Volume

The amount of the substantially non-aqueous liquid cleaning composition is each unit dose envelope may for example be from 10 ml to 100 ml, e.g. from 12.5 ml to 75 ml, preferably from 15 ml to 60 ml, more preferably from 20ml to 55 ml.

Processing

The present invention also encompasses a process for preparing a concentrated liquid detergent composition comprising nonionic surfactant, an organic solvent and pigment, said process comprising the steps of mixing the nonionic surfactant with the organic solvent, adding to this mixture the pigment in the form of a pigment premix whereby at least 90% of the pigment particles have a particle size of less than 50 micron, preferably less than 30 micron, and adding other composition ingredients.

In a first step the nonionic surfactant is mixed with the organic solvent. It is essential that the pigment premix is added to a detergent base comprising the organic solvent for proper mixing of the pigment. If linear alkylbenzene sulfonic acid is used this is preferably in situ neutralised with ethanolamine in the event that liquid detergent composition is to be encapsulated in a water soluble film. In some cases, NaOH or KOH may also be used in addition or in stead of ethanol amine, depending on the compatibility between the liquid detergent composition and the water-soluble film.

Preferably, the premix comprises 1–40% pigment, 1–95% of an organic solvent and optionally a surfactant selected from the group consisting of nonionic, anionic, cationic, zwitterionic surfactants and mixtures thereof.

In most cases it is preferred that the premix further comprises at least one preservative.

The premix may be prepared by mixing the pigment and an organic solvent, preferably monopropylene glycol, in a bead mill until the desired particle size distribution, colour strength etc has been obtained. To control the exact particle size distribution this mixture may then passed through an appropriate sieve. The mixture preferably comprises a mixture of a nonionic and a anionic surfactant.

Other than in the examples, or where otherwise indicated, all numbers expressing quantities of ingredients or reaction conditions used herein are to be understood as modified in all instances by the term "about". Similarly, all percentages are weight/weight percentages of the liquid detergent composition unless otherwise indicated. Where the term "comprising" is used in the specification or claims, it is not intended to exclude any terms, steps or features not specifically recited.

The invention is more fully illustrated by the following non-limiting examples showing some preferred embodiments of the invention.

EXAMPLE

Concentrated liquid detergent composition

| Ingredient | Wt % |
|---|---|
| Nonionic surfactant | 26.6 |
| Monopropylene glycol | 5.5 |
| Pigment premix | 0.017 |
| Glycerol | 21.36 |
| Monoethanolamine | 7.56 |
| Oleic fatty acid | 13.10 |
| Water | Up to 100 |
| Linear alkyl benzene sulfonate | 20.1 |
| Perfume | 1.6 |
| Protease Enzyme | 1.0 |

The pigment premix was prepared mixing a copper phthalocyanine pigment with monopropylene glycol in a bead mill and then passing it through a sieve to obtain the particle size according the invention. The composition was stable after 12 wks at 37° C. Laundry cleaned with the composition did not show pigment spotting. The liquid detergent composition of the example which was also encapsulated in a transparent water-soluble film was colour stable.

What is claimed is:

1. A concentrated, aqueous, liquid detergent composition, which is stably encapsulated in a water-soluble film and which comprises:

(a) 1–90% of at least one nonionic surfactant, (b) 1–60% of an organic solvent, (c) 0.0001–2% of a pigment wherein at least 90% of the pigment particles have a particle size of less than 50 micron; and (d) a molar excess, with respect to the amount of exchangeable hydrogen ions in an at least one ionic ingredient, of a stabilising compound effective for combining with the exchangeable hydrogen ions, selected from the group consisting of monoethanolamine, triethanolamine, alkali metal hydroxides, alkaline earth metal hydroxides, ammonium hydroxide, and mixtures thereof with the proviso that if the stabilising compound is or comprises an inorganic base and/or ammonium hydroxide then it is present in an amount of at least 95 mole % of the amount to completely neutralise the at least one ionic ingredient.

2. A composition according to claim 1 characterised in that further at least 50% of the pigment particles have a mean particle size of less than 10 micron.

3. The composition of claim 1, wherein the pigment is selected from the group consisting of phthalocyanines, water-soluble or water-dispersible derivatives thereof and mixtures thereof.

4. A composition according to claim 1 characterised in that the composition comprises less than 20% water.

5. A composition according to claim 1 characterised in that the pigment has a non-white colour.

6. The composition of claim 1, wherein the organic solvent is selected from the group including monopropylene glycol, glycerol, polyethylene glycol and mixtures thereof.

7. The composition of claim 1, wherein the pigment particles have a particle size of less than 30 micron.

8. A composition according to claim 1 characterised in that further at least 50% of the pigment particles have a mean particle size of less than 5 micron.

9. The composition of claim 1, wherein the pigment has a color selected from the group consisting of blue, green and blue-green.

* * * * *